US005878393A

United States Patent [19]

Hata et al.

[11] Patent Number: 5,878,393

[45] Date of Patent: Mar. 2, 1999

[54] HIGH QUALITY CONCATENATIVE READING SYSTEM

[75] Inventors: Kazue Hata, Santa Barbara; Nicholas Kibre, Lompoc, both of Calif.

[73] Assignee: Matsushita Electric Industrial Co., Ltd., Osaka, Japan

[21] Appl. No.: 709,581

[22] Filed: Sep. 9, 1996

[51] Int. Cl.[6] ..... G10L 5/02

[52] U.S. Cl. ..... 704/260; 704/266

[58] Field of Search ..... 704/260, 258, 704/267, 257, 266, 275, 270

[56] References Cited

U.S. PATENT DOCUMENTS

| | | | |
|---|---|---|---|
| 3,704,345 | 11/1972 | Coker et al. | 704/266 |
| 4,685,135 | 8/1987 | Lin et al. | 704/260 |
| 4,692,941 | 9/1987 | Jacks et al. | 704/268 |
| 4,947,438 | 8/1990 | Paeseler | 704/252 |
| 4,979,216 | 12/1990 | Malsheen et al. | 704/260 |
| 5,384,893 | 1/1995 | Hutchins | 704/267 |
| 5,396,577 | 3/1995 | Oikawa et al. | 704/260 |
| 5,636,325 | 6/1997 | Farrett | 704/258 |
| 5,642,466 | 6/1997 | Narayan | 704/260 |
| 5,651,095 | 7/1997 | Ogden | 704/260 |

*Primary Examiner*—Richemond Dorvil
*Attorney, Agent, or Firm*—Harness, Dickey & Pierce, P.L.C.

[57] ABSTRACT

Computer-stored text, such as numerical information, is processed by a word list generator to develop a word list corresponding to those words that are to be spoken by the system. The word list generator assigns a prosodic environment state or token to each entry in the list. The prosodic environment identifies how the word functions in its current prosodic context. Different intonations are applied based on the prosodic environment. Next, the preceding and adjacent words are examined to determine how each word may need to be pronounced differently, based on the ending phoneme of the preceding word and the beginning phoneme of the following word. Using this phonological information along with the prosodic information, a sample list is generated by accessing a dictionary of stored samples. The sample list is then serially played through suitable digital-to-analog conversion circuitry to generate the text-to-speech output. The result is a natural, human-like reading, complete with appropriate intonation changes suitable to the context of the text material.

12 Claims, 4 Drawing Sheets

12
16
16
26
SCSI
DISK
24
20
CPU
RAM
22
26
Sound Card
28
D/A
Amp
30
16
40
Dictionary of Samples
Input Buffer
44
42
Word List Generator
46
Prosodic Environment Table
48
Word List Buffer
50
Phonologic Feature Analyzer
Phonologic Feature Table
52
Sample List Buffer
54
TO OUTPUT

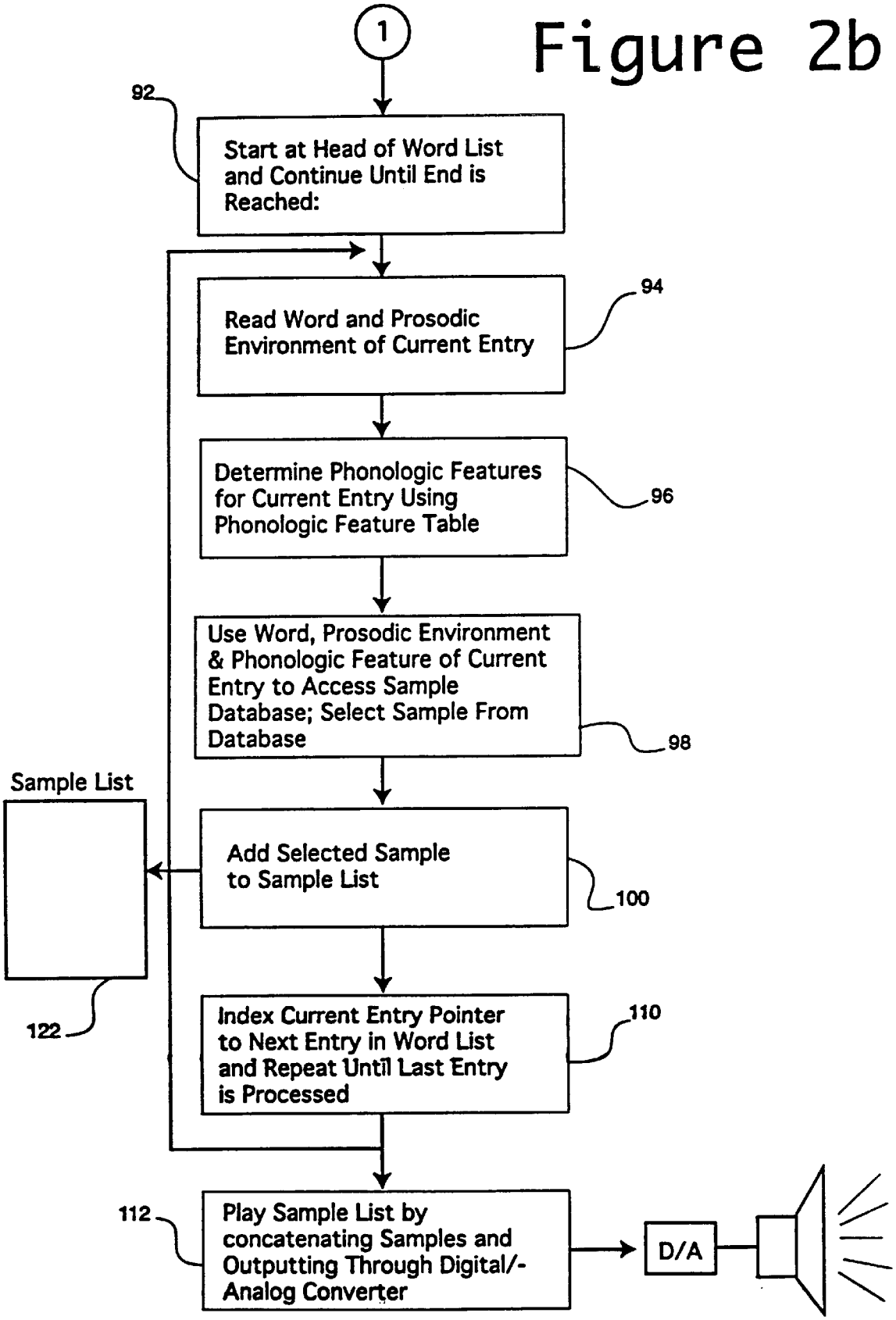
Figure 2b
1
92
Start at Head of Word List and Continue Until End is Reached:
Read Word and Prosodic Environment of Current Entry
94
Determine Phonologic Features for Current Entry Using Phonologic Feature Table
96
Use Word, Prosodic Environment & Phonologic Feature of Current Entry to Access Sample Database; Select Sample From Database
98
Sample List
Add Selected Sample to Sample List
100
122
Index Current Entry Pointer to Next Entry in Word List and Repeat Until Last Entry is Processed
110
112
Play Sample List by concatenating Samples and Outputting Through Digital/-Analog Converter
D/A Environment Table
01 = Initial
02 = Final
03 = Comma
46
Dictionary
Token
Word
Sample
0001 "One"
0002 "Two"
0110 "Dollars"
0111 "Cents"
4001 "Hundred"
4002 "Thousand"
40
Word List
Token
Prosodic Environment
0001 01
4002 03
0002 01
0111 02
120
Phonologic Feature Table
Token
Begins With
Ends With
0001 vowel •••
52
122
Sample List
"One"
Digital Sample
Phonologic Feature
Environment
Token

HIGH QUALITY CONCATENATIVE READING SYSTEM

BACKGROUND AND SUMMARY OF THE INVENTION

The present invention relates generally to text-to-speech (TTS) reading systems. More particularly, the invention relates to a concatenative reading system that produces high quality, naturally articulated speech by taking into account the prosodic environment of the words to be concatenated and also the phonological features of adjacent words to provide natural-sounding intonation. The system is particularly useful in reading numbers in tables, spreadsheets and the like.

In the process of data entry into a computer from written records, proofreading is a tiring and time-consuming task. The data entry operator must constantly shift the eyes between the computer screen and the paper originals. Sometimes, if two people are available, they can share the proofreading task: one person reading the data out loud from the paper originals and the other checking the entry on the computer screen.

This process of proofreading data entry can be facilitated through use of a speech synthesis system. Such a system allows the operator to keep the eyes on the paper originals while listening to what has been entered. The operator does not need another person to read the data from the paper originals because the speech synthesis system handles this aspect. Thus the operator can work alone. However, current speech synthesis systems are fatiguing to use, because speech quality is poor, lacking natural-sounding phrasing and intonation. User fatigue leads to errors. Hence current speech synthesis systems have proven deficient for critical proofreading applications. User fatigue is particularly prevalent in number reading systems, where a monotonous tone and poor phrasing leads to many errors.

The present invention provides a reading system that has a very natural voice with which the data entry operator can work without fatigue. The reading system employs a concatenative technique whereby digitally recorded speech samples are concatenated or joined together to produce the speech output. The invention achieves a more life-like output by incorporating two variables of natural speech: (1) prosodic or intonational variation and (2) variation due to coarticulation of each word's initial and final phonemes with the final and initial phonemes of adjacent words. For each use of a word, a set of prosodic and segmental environment rules are applied to select a contextually appropriate digital sample. The result is a much more natural sounding synthesized speech that does not induce fatigue. Operators using the system thus enjoy a much lower error rate.

The system of the invention captures what a human speaker does while proofreading. It reads numbers in a column or row, using a nonfinal intonation for all but the last entry. This intonation gives the listener a cue that the current number is not the final one in the column or row. This contextual cue is extremely helpful in proofreading, as the user is cued when the final number in the column or row is reached. This information is very valuable in detecting insertion and deletion errors, where the text on the computer screen and the text on the paper originals do not have the same number of entries due to data entry error.

The invention comprises a high-quality concatenative reading system for converting an input string into a sequence for subsequent audible synthesis. The invention includes a dictionary of words stored in a computer-readable storage medium and a word list generator coupled to the dictionary. The word list generator is receptive of the input string for building and storing entries in a word list within the computer's memory. The word list generator builds the word list from words stored in the dictionary to correspond to the input string. The generator has a set of stored rules for adding numeric placeholder words that correspond to integers in the input string. Thus the word list generator will insert the appropriate numeric placeholders so that the integer number "1,243" will be pronounced "one thousand, two hundred forty-three."

The word list generator further includes a list of prosodic environment tokens that represent a plurality of intonation types. The word list generator assigns at least one of the prosodic environment tokens to at least some of the word list entries. The preferred embodiment assigns a prosodic environment token to each of the words in the word list.

The reading system also includes a database of speech samples stored in computer-readable memory. A phonological feature analyzer analyzes the word entries in the word list to determine the prosodic environment of those words. Specifically, the preferred embodiment consults a phonological feature table to determine what each word begins with and ends with. These features are compared with adjacent words to determine the phonological environment of each word. In natural speech, phonemes are pronounced differently in different phonological contexts. The adjacent phonemes affect how a phoneme will sound when spoken. In this case, the invention concentrates on the beginning and ending phonemes, altering the pronunciation based on the words that precede and follow each word entry.

Using the word list constructed by the word list generator, together with the prosodic environment information and phonological feature information, the reading system constructs a sample list from the database of speech samples. The sample list represents the actual sampled data that are concatenated to supply the sequence for audible synthesis. The sample list may be output through a digital-to-analog converter to produce an audible signal that may be amplified and played through a suitable speaker system.

For a more complete understanding of the invention, its objects and advantages, reference may be had to the following specification and to the accompanying drawings.

DESCRIPTION OF THE PREFERRED EMBODIMENT

Figure 1:
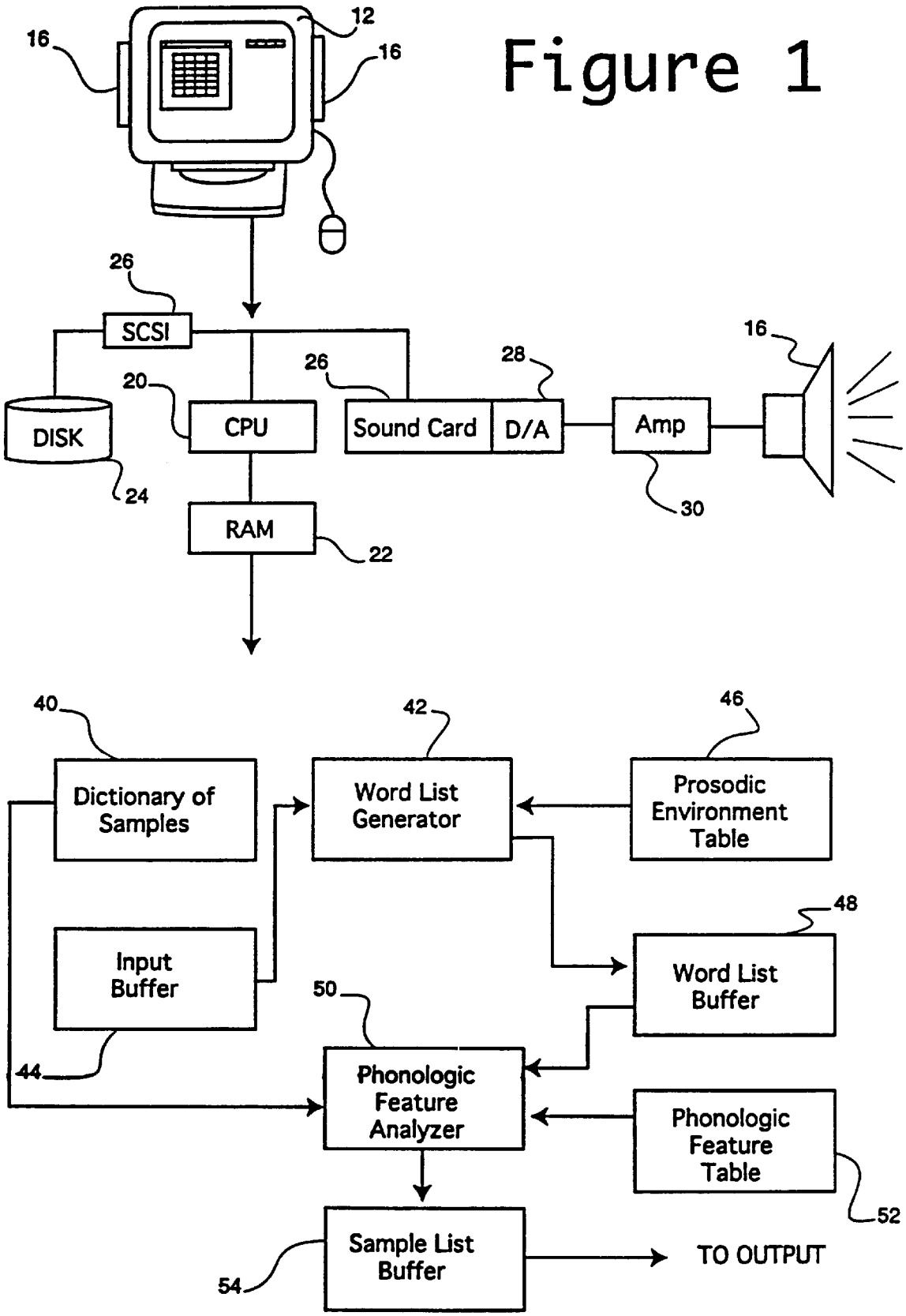
FIG. 1 is a block diagram illustrating the presently preferred architecture of the computer-implemented number reading system.

The number reading system is depicted diagrammatically in FIG. 1. The system is designed to be implemented by a computer that has been programmed in accordance with the software system described herein. In FIG. 1 the computer 10 with monitor 12 has been illustrated. Displayed on monitor 12 is a target application 14, such as a spreadsheet application, that will be the source of input to the number reading system of the invention. Computer 10 includes a suitable speaker system. In the illustrated embodiment, speakers 16 are disposed on the left and right sides of the monitor. Of course, other speaker locations are also possible.

FIG. 1 also illustrates some of the more important internal components of computer system 10. These include the central processing unit or CPU 20, random access memory or RAM 22 and a disk drive system including disk storage 24 and suitable disk interface circuitry such as SCSI circuitry 26. These components are connected together by means of the computer bus forming a part of computer system 10. The preferred embodiment is designed to work with a commercially available sound card 26. The sound card includes suitable digital-to-analog conversion circuitry 28 for converting digitally recorded samples into analog signals that may be amplified by amplifier 30 for playing through speaker 16. The sound card preferably connects to the CPU 20 by attachment to the computer bus, as illustrated. The sound card can be, for example, a commercially available Soundblaster card available from Creative Labs, Inc.

The computer system 10 is programmed to implement several functional modules. These are illustrated in FIG. 1 and will be described next.

The reading system of the invention is a concatenative reading system. Concatenation is the process of stringing together or combining individual speech samples into a sequence. The individual speech samples each represent discrete units of speech, such as phonemes or words. The individual samples are strung together to produce a single sequence that, when played through the sound card at the proper sampling rate, produces sound that simulates speech. Although concatenative speech systems are known, the present invention greatly improves upon existing concatenative speech techniques by taking into account prosodic environment and phonological features. The reading system of the invention uses these attributes to generate natural-sounding speech, having the appropriate pronunciation, intonation, inflection and phrasing for the given context. The result is more natural speech that is less fatiguing to listen to.

The reading system has a dictionary of sampled sounds 40. These are digitally sampled sounds that have been recorded and stored in advance. The sampling rate used to digitize the speech samples can be selected based on system requirements. If memory resources are limited, a lower sampling rate (e.g. 11 kilohertz) may be used. For higher quality speech a higher sampling rate (e.g. 22 kilohertz) may be used. If compact disc quality audio is desired, a still higher (e.g. 44.1 kilohertz) sampling rate may be used. If desired, the dictionary of samples can include separate dictionaries of sampled sounds, sampled at different sampling rates. The reading system could be provided with a suitable button in the user interface control system to select which dictionary should be used. In general, the dictionary of samples comprises a complete collection of all possible sounds that the concatenative reading system may string together. For number reading systems having a relatively limited vocabulary (i.e., a limited number of possible words the system can pronounce) the dictionary entries can be individual words. In more complex reading systems, where a larger vocabulary must be supported, the dictionary of samples may store more elemental speech components, such as individual phonemes. Whether to store entire words or individual phonemes is largely a system design issue. The system designer should select the appropriate "granularity" or dictionary entry size to suit the specific application.

The presently preferred embodiment has been optimized as a number reading system. Hence each entry in the dictionary of samples 40 is a digitally recorded sample of an individual word. As will be more fully explained below, the present system achieves a more natural sounding output by taking prosodic environment and phonological features into account. When a human reads from a prepared text, the spoken words are given different intonation or voice pitch, depending on how they are used and where they appear in the prepared text. The human reader instinctively alters the intonation according to the prosodic environment of the words being spoken. The change in intonation provides a powerful cue to the listener, conveying prosodic information, such as where phrases begin and end, or where sentences begin or end, or where columns of numbers begin and end. These prosodic cues are not limited to phrase and sentence structure. They also convey important information when reading numbers. In the English language, numbers are naturally subdivided into triplets. These triplets are commonly punctuated with commas (e.g. 1,234). When reading numbers in the English language, the reader uses different voice pitch or intonation on the different individual digits, according to where they appear in the overall number. Thus the preceding example (1,234) would be pronounced "one thousand, two hundred thirty-four," with different pitch contour placed on the beginning digit (1), the digit following the commas (2) and the ending digit (4).

Because the individual words may have different pitch contours, depending on the prosodic environment, the dictionary of samples 40 includes a different sample for each pitch contour. Thus, in a number reading system that is designed to simulate spoken English, three different intonations or pitch contours may be employed: an initial intonation, a pre-pausal intonation and a final intonation. Thus each word in the dictionary would be stored three times, one for each intonation.

To further refine the output quality, the number reading system also takes into account the fact that a human reader will pronounce phonemes differently, depending on what sounds immediately precede and follow that phoneme. These are phonological features that give synthesized speech a more natural, human-like quality. The concatenative reading system of the invention analyzes each of the concatenated elements (e.g. phonemes or words) to select the proper sound based on the element's adjacent neighbors. In the preferred embodiment that has been optimized for number reading, individual words are stored in the dictionary 40 in a variety of forms, corresponding to the different pronunciations that may be required in certain phonological settings. Thus, in addition to storing one entry for each of the prosodic environments, dictionary 40 also stores all pronunciation variants of the word for each prosodic environment. Thus, regardless of what word precedes or follows a given word and regardless of what the prosodic environment may be, the dictionary 40 contains a sample to match.

Returning to FIG. 1, the number reading system employs a word list generator 42 that performs the first pass of the two-pass system of the preferred embodiment. Word list generator 42 accesses an input buffer 44 containing the text to be converted to speech. The input buffer can be loaded with text through any suitable mechanism. For example, the input buffer can be loaded by copying data from the target application 14. Word list generator 42 includes a prosodic environment table 46 that identifies the different possible prosodic environment states of the implementation. The preferred embodiment defines three prosodic environment states, an initial state, a final state and a pre-pausal state.

These three states work well in number reading applications for which the current preferred embodiment has been optimized. Of course, a system may be constructed with a larger or fewer number of prosodic environment states, depending on the application.

Word list generator 42 processes the text stored in input buffer 44 to build a word list. This is stored in a word list buffer 48. The process will be described more fully below in connection with FIGS. 2 and 3.

Essentially, the word list is a list containing word token for each word that will need to be synthesized in the output speech. These word tokens are arranged in the order they will be pronounced in the output speech. Associated with each word is a prosodic environment token, to signify the prosodic state of each word in the word list.

The reading system further comprises a phonological feature analyzer 50. The feature analyzer includes a phonological feature table 52 that identifies, for every word in the dictionary, what the word begins with and ends with. The phonological feature analyzer analyzes each entry in the word list buffer, using the phonological feature table 52 to examine the words that precede and follow each entry in the word list buffer. Using this information the phonological feature analyzer accesses the dictionary of samples 40 to build a sample list. The sample list is stored in the sample list buffer 54. Stored in the sample list buffer are the actual digital samples corresponding to the appropriate prosodic environment and phonological features of the words in the word list buffer. The sample list buffer may then be serially output through the digital-to-analog converter 28 to produce the audible speech output signal.

Figure 2A:
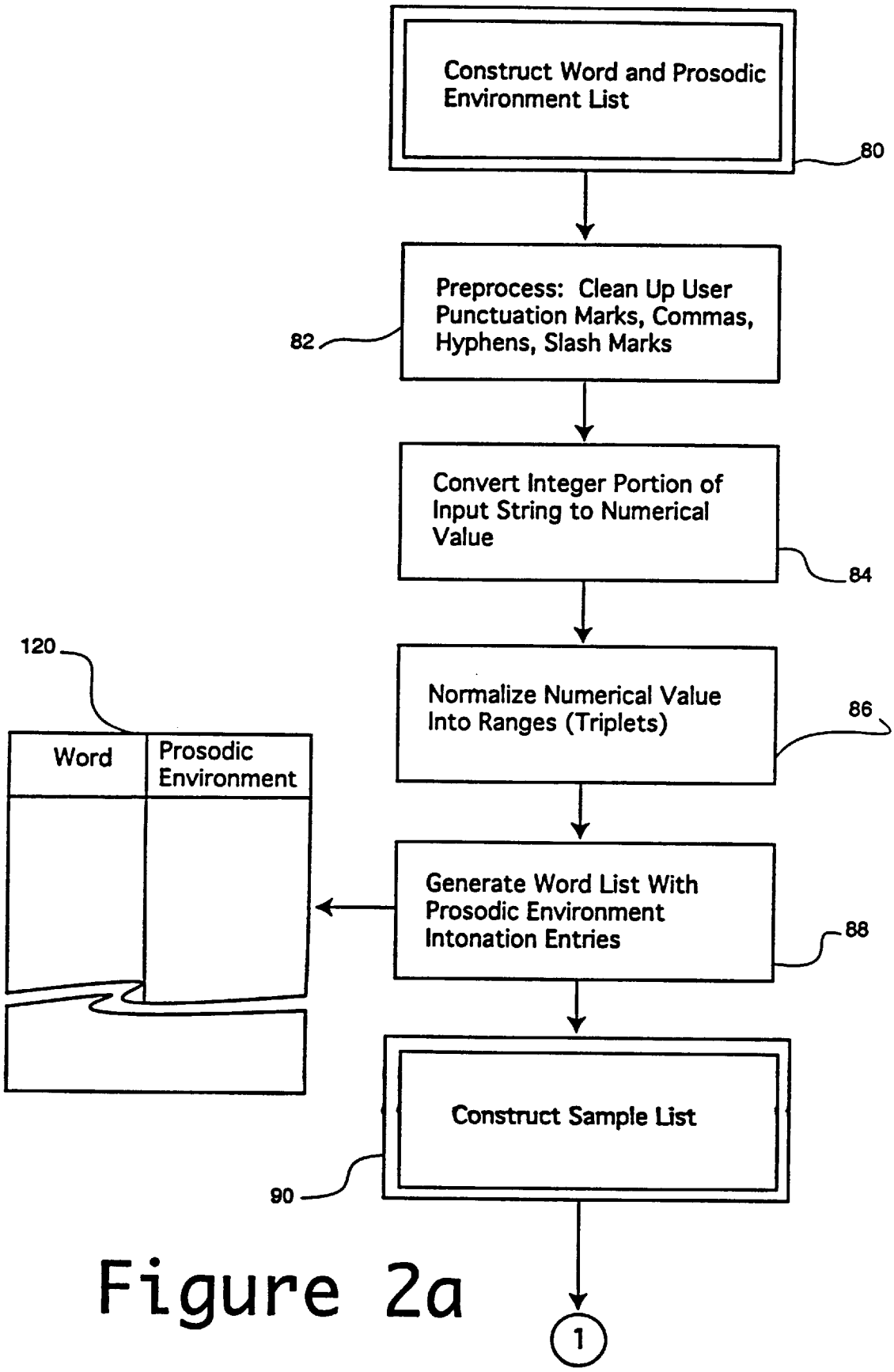
FIG. 2 (FIGS. 2*a* and 2*b*, collectively) is a flowchart diagram showing the computer-implemented process performed by the number reading system of the preferred embodiment.

The word list generator 42 and phonological feature analyzer 50 effect a two-pass conversion process. This process is depicted in FIG. 2. During the first pass the word and prosodic environment list is generated. During the second pass the sample list is generated. In FIG. 2 the first pass begins at Step 80 and the second pass begins at Step 90.

After the input text has been loaded into the input buffer 44 the word list generator performs a preprocessing step (Step 82). In the preprocessing step the text in the input buffer is cleaned up to remove or standardize any user punctuation marks. Thus, in a number reading system the preprocessing step will clean up commas, hyphens and slash marks, making them consistent throughout the text. These punctuation marks can serve as prosodic cues to denote where pauses or other words should be injected. For example, the hyphen may be read as "minus" and the slash mark may be read as "divided by." Commas may signify how a number is divided into triplets.

Next, (Step 84) the integer portion of the input string is converted to numerical values. To explain, numbers written in text appear as ASCII characters representing the individual digits of the number. So that the number can be properly processed for text-to-speech conversion, the ASCII representation must be converted into a numerical representation. In effect, the ASCII character string representing the ordinal numbers is converted into an integer form that the computer will treat as an integer data type.

After conversion of the number into a numerical value, the number is normalized into ranges in Step 86. In English language text-to-speech applications, numbers are typically normalized or grouped into triplets. Other languages may group numbers into different ranges. For example, in Japanese, the numbers are grouped into groups of four digits. By grouping the numerical value into ranges such as triplets, the word list generator is then able to insert the appropriate placeholder words in the word list. Thus, the numerical value "1,200" would generate the word list "one-thousand-two-hundred."

Figure 3:
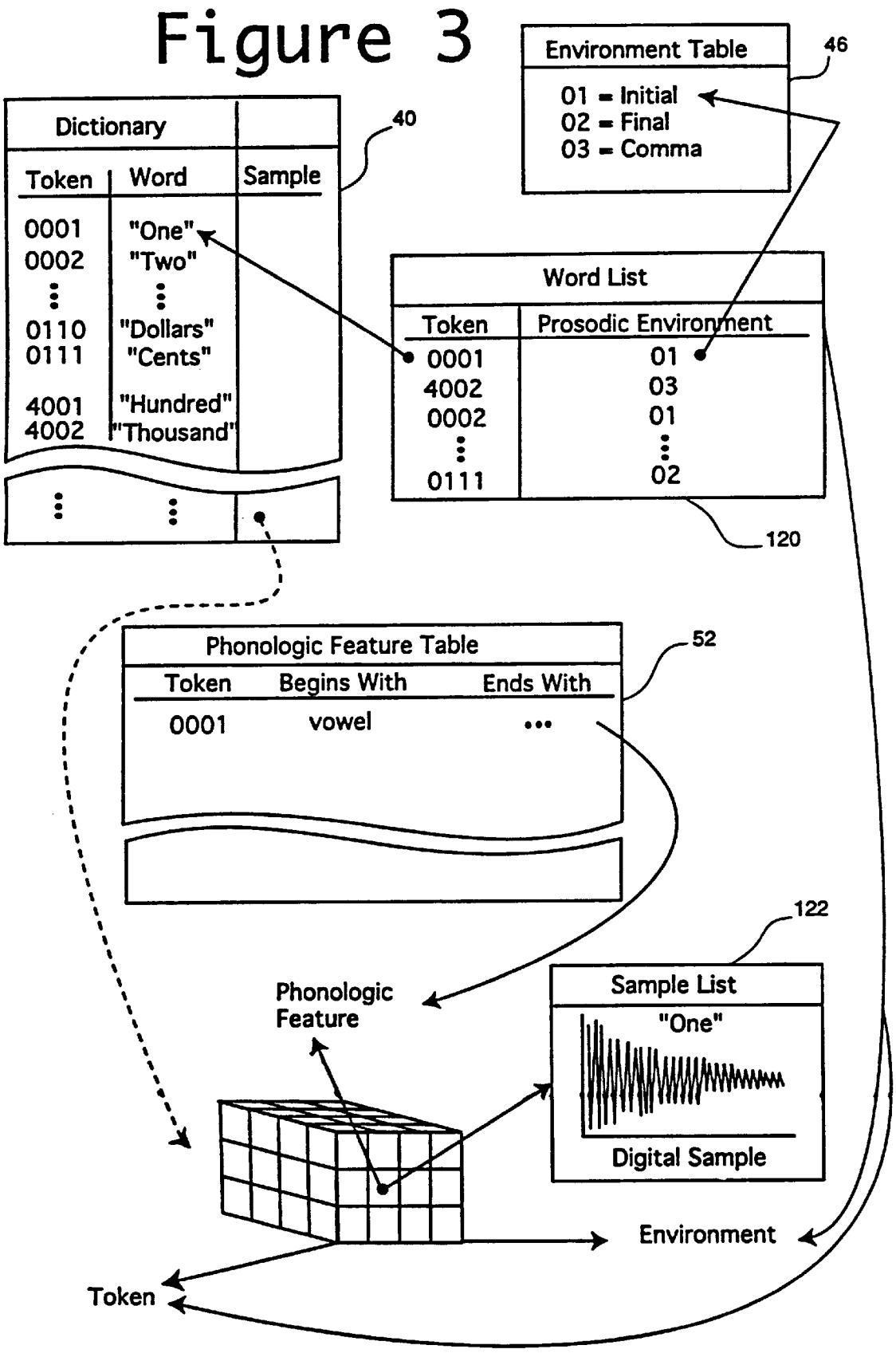
FIG. 3 is a data structure diagram illustrating the presently preferred data structures generated by and manipulated by the number reading system of the invention to produce high-quality concatenated synthesized speech.

Accordingly, in Step 88 the word list generator generates the word list, storing it in the word list data structure 120. The word list data structure, described more fully below in connection with FIG. 3, is stored in the word list buffer 48. As illustrated, the word list data structure comprises an array of ordered pairs. Each ordered pair comprises a token, representing a word to be spoken, and the prosodic environment state of that word. The word list generator determines the prosodic environment state by accessing the prosodic environment table 46 to assign an environment token indicating what intonation should be used when pronouncing the word in its current prosodic environment. Specifically, the word list generator examines the word in relation to its location within the text of the input buffer and its relation to placeholder punctuation marks. If the word appears as the initial word in a numerical value, it is assigned an initial state token. If the word is the final word in the numerical value it is assigned a final state token; and if the word meets other criteria, it is assigned a pre-pausal state token. The precise rules for assigning environment state tokens are set forth in the pseudocode appearing in the Appendix. The pre-pausal state is referred to as the "comma" state in the pseudocode.

After the word list has been constructed, the second processing pass begins at Step 90. Essentially, the second pass examines each entry in the word list and builds a sample list. Starting at the head of the word list and continuing through the list until the end is reached, a processing loop is performed. (See Steps 92–110). In Step 94 the word and prosodic environment tokens are read from the current entry in the word list. Next, in Step 96, the phonological features for the current entry are determined using the phonological feature table 52. Specifically in this step, the words adjacent (preceding and following) the current word are examined. The end of the preceding word and the beginning of the following word are used to access the phonological feature table 52 to determine the phonological feature state of the current word.

In Step 100 the current word, its prosodic environment attribute and its phonological feature attribute are used to look up and copy the appropriate digital sample into a sample list data structure 122. The sample list data structure is stored in the sample list buffer 54. Essentially, this step builds the sample list by selecting the digital sample having the appropriate sound and intonation for the current context. After adding the digital sample entry to the sample list, the procedure (in Step 110) indexes the current entry pointer to the next entry in the word list. The procedure then branches back to Step 94 where the cycle is repeated over and over, until the last entry in the word list is processed.

After the last entry in the word list has been processed, the sample list contains a full sequence of all digital samples needed for a concatenative playback. This is illustrated at Step 112, where the sample list is played by sequentially outputting the samples through the digital-to-analog converter in the order stored. This results in a concatenated synthesized speech signal that may be amplified and played through the speaker 16.

To further illustrate the invention in its preferred embodiment, FIG. 3 shows some of the data structures that are used in the current implementation. The data structures are physically implemented as objects in the computer random access memory 22. Word list 120 (stored in the word list buffer 48) is essentially an array of integers to which codes or tokens are assigned to represent the words in the system's finite vocabulary. The word list comprises a set of ordered pairs, each ordered pair comprising a token to represent a word from the dictionary of samples 40 and a prosodic environment state token associate with that word. The prosodic environment state tokens are described in the environment table 46. In the preferred embodiment three states are recognized, initial, final and pre-pausal. Of course, systems may be implemented using a different number of prosodic environment states if desired. Word list 120 is populated with data by word list generator 42 during the first processing pass.

The second processing pass involves populating the sample list data structure 122 that is stored in the sample list buffer 54. The phonological feature analyzer 50 identifies the word preceding and the word following the current entry and accesses the phonological feature table 52 to ascertain what the word begins with and ends with. With this information the phonological feature analyzer then selects the appropriate sample from dictionary 40. Selection of the appropriate sample involves knowing three pieces of information: the word identifier or token, the prosodic environment associated with that entry and the phonological features that affect pronunciation of the entry in its current context. The word identifier token and prosodic environment information come from the word list. The phonological feature information is obtained by accessing the feature table as described above. With this information the proper sample is identified and extracted from dictionary 40. The sample is placed into the sample list data structure 122 as a digital sample that will be later played through the sound card and associated audio equipment.

From the foregoing it will be appreciated that the present invention provides a concatenated reading system that combines prosodic environment and phonological information to achieve a more natural, human-like reading. Although the present invention has been illustrated and described with reference to a number reading system, it will be apparent that the techniques employed in the illustrated embodiment can be applied to other types of reading systems. Accordingly, it will be understood that the invention is capable of certain modification or change without departing from the spirit of the invention as set forth in the appended claims.

APPENDIX

Objects in Memory:

A list of "words"; an array of integers, which can be assigned codes representing the words in the system's finite vocabulary.

A list of "prosodic environments"; an array of integers, where each one can be assigned a code representing one of a class of intonational types, i.e., "initial," "final," "comma," etc.

A table of phonologicalal features; an array of phonologicalal features belonging to each of the words in the system's vocabulary. Features represent the type of phonemes which words may begin and end with, so that sample features might be "ends with a vowel" or "begins with an S."

A set of recordings (or "samples") of each of the words in the system's vocabulary, with multiple recordings of each as is appropriate for different environments.

A list of "samples" to be played back in sequence through the audio device.

Module I: Construct Word and Prosodic Environment List

Several different modules may be used here, depending on what types of numbers and statements are to be generated. As an example, we present pseudocode for generating integers between 1 and 999,999,999.

Where I speak of "adding word X with intonation Y," this means that new entries are made in the word list and prosodic environment list as described above, and that these are assigned the values X and Y, respectively.

Clean up input string.

Convert integer portion to a number value.

For each triple (millions, thousands, ones), do the following: (for example, if the integer supplied is 123,049,228, make three passes through this loop using 123, 49 and 228).

If hundreds place is not zero, add "one"–"nine" plus "hundred"; select final intonation if tens and zeros places are both zero, and we're in the ones triple, otherwise neutral intonation.

If tens place is one and ones place is nonzero:

add appropriate "teen" words; select final intonation if this is the ones triple, otherwise neutral intonation.

Else:

If tens place is nonzero, add "ten," "twenty," . . . "ninety," depending on this value; use final intonation if ones place is zero and this is the ones triple, otherwise neutral intonation.

If ones place is nonzero, add "one," "two," . . . "nine," depending on its value; use final intonation if ones place is zero and this is the ones triple, otherwise neutral intonation.

If this is the millions triple, add the word "million"; if this is the "thousands" triple, add the word "thousand." If this is the millions triple and last six digits of the number are 000000, or if this is the thousands triple and the last three digits of the number are 000 (in other words, if the value of the whole integer divided by the base leaves a remainder of zero), then use final intonation, otherwise use comma intonation.

Module II: Construct Sample List

The function of this module is to fill the sample list described earlier with codes corresponding available samples.

The module proceeds through the word list and prosodic environment list one by one (in the order they were added to it), and selects a sample for each one according to a set of rules which may be sensitive to any of the following:

the identity of this word;

the prosodic environment of this word;

the phonological features of the preceding word (as discovered by looking them up in the phonologicalal feature table).

Likewise, the phonologicalal features of the following word.

What is claimed is:

1. A high quality concatenative reading system for converting an input string into a sequence for audible synthesis, comprising:

a dictionary of complete word speech samples corresponding to entire words stored in a computer-readable medium;

a word list generator receptive of said input string for building and storing word list tokens in a word list, the word list generator building said word list from words stored in said dictionary that correspond to the input string;

said word list generator further having a list of prosodic environment tokens representing a plurality of intonation types, said word list generator assigning at least one of said prosodic environment tokens to at least some of the word list tokens;

phonological feature analyzer that analyzes said word list tokens and said assigned prosodic environment tokens and selects said complete word speech samples from said dictionary to build a sample list based on (a) the word list tokens, (b) the prosodic environment tokens and (c) the phonological features of adjacent words; and output for concatenatively supplying said sample list to an analog conversion unit to produce an audible text-to-speech signal.

2. The reading system of claim 1 wherein the word list generator is further operable to add numeric placeholder words corresponding to integers in said input string.

3. The reading system of claim 1 wherein said set of speech samples includes a speech sample entry for each of said plurality of intonation types.

4. The reading system of claim 1 wherein said word list generator builds said word list as ordered pairs, each pair comprising a word token and a prosodic environment token.

5. The reading system of claim 1 wherein said phonological feature analyzer examines at least the word preceding an entry in the word list to determine the phonological features of adjacent words.

6. The reading system of claim 1 wherein said phonological feature analyzer examines at least the word following an entry in the word list to determine the phonological features of adjacent words.

7. A method of text-to-speech conversion, comprising:

receiving an input string representing text to be covered into audible synthesized speech;

constructing a word list of word tokens corresponding to the input string by accessing a dictionary of complete word speech samples corresponding to entire words stored in a computer-readable medium;

supplementing said word list with prosodic environment tokens that represent different intonation types, such that at least some of the word tokens in said word list are associated with a corresponding prosodic environment token;

analyzing the phonological attributes associated with the word tokens in said word list by examining the phonological features of adjacent words in said list;

selecting complete word speech samples from said predetermined dictionary of complete word speech samples corresponding to entire words based on (a) said word list tokens, (b) said corresponding prosodic environment tokens, and (c) said phonological attributes; and building a sample of list said selected complete word speech samples and supplying said sample list for concatenative output to an analog conversion unit to produce an audible text-to-speech signal.

8. The method of claim 7 wherein the step of constructing said word list includes adding numeric placeholder words corresponding to integers in said input string.

9. The method of claim 7 wherein said set of speech samples includes a speech sample entry for each of said different intonation types.

10. The method of claim 7 wherein said step of building a word list comprises building said word list as ordered pairs, where each pair comprises a word token and a prosodic environment token.

11. The method of claim 7 wherein said step of analyzing the phonological attributes comprises examining at least the word preceding an entry in the word list to determine the attribute based on phonological features of the preceding word.

12. The method of claim 7 wherein said step of analyzing the phonological attributes comprises examining at least the word following an entry in the word list to determine the attribute based on phonological features of following word.

* * * * *